United States Patent [19]

Bassinger

[11] 4,106,823

[45] Aug. 15, 1978

[54] BOREHOLE CONTACTING APPARATUS FOR BOTTOM HOLE ASSEMBLY

[76] Inventor: Grey Bassinger, 2201 Country Club Dr., Midland, Tex. 79701

[21] Appl. No.: 845,777

[22] Filed: Oct. 26, 1977

[51] Int. Cl.[2] ..... F16C 1/26

[52] U.S. Cl. ..... 308/4 A; 175/325

[58] Field of Search ..... 308/4 A, 8.2, 4 R, 5 R, 308/239, 3 R; 175/325, 346, 377, 246, 272, 406

[56] References Cited

U.S. PATENT DOCUMENTS

| | | | |
|---|---|---|---|
| 2,864,586 | 12/1958 | Backer | 308/4 A X |
| 3,454,308 | 7/1969 | Kennedy | 308/4 A |

*Primary Examiner*—Trygve M. Blix
*Assistant Examiner*—Douglas C. Butler

[57] ABSTRACT

A borehole wall contacting apparatus on a bottom hole assembly of a drill string for contacting the borehole wall including a plurality of dovetail grooves having outwardly converging opposed sidewalls formed in the apparatus body for receiving at least one pair of coacting stabilizer wear blades, each blade having opposed contact and camming sidewalls with relative longitudinal engagement of the camming walls of the coacting wear blades wedging the opposed sidewalls into engagement with the opposed converging dovetail walls to removably secure the wear blades into position.

14 Claims, 5 Drawing Figures

BOREHOLE CONTACTING APPARATUS FOR BOTTOM HOLE ASSEMBLY

BACKGROUND OF THE INVENTION

This invention relates generally to borehole wall contacting apparatus mounted on a bottom hole assembly of a drill string. More specifically, the invention is directed to a stabilizer with replaceable wear pads which are easily replaced with minimum down time during drilling operations.

A "bottom hole assembly" is a term of art which has been used to designate the combination of drill collars and various borehole wall contacting tools on the lower part of a drill string. Bottom hole assemblies are commonly used to influence behaviour of a drill bit. Long or multiple wall contact tools extending above a drill bit have at least a dual purpose. The bit footage (feet drilled before replacement of bit is required) can be increased because wall contacting tools act to force the drill bit to rotate on its center which helps protect gauge surfaces and also helps to maintain the bottom hole cutting pattern. Wall contact tools also help to prevent wobbling of the lower drill collar assembly, thereby keeping more equal loading on the cones of a drill bit. The close fitting contact tools engage the borehole wall and act as a drill string bushing to keep the hole targeted in the direction it is pointed.

Various types of wall contact tools have heretofore been known. Wall contact tools may take the form of a non-rotating stabilizer which may be made at least partially of rubber and is subject to damage in boreholes. Another known type of wall contact tool has rotating blade stabilizers with either short short spiral blades or relatively straight blades and which may serve the dual purpose of stabilizing and reaming.

Blade stabilizers consist of essentially three types, namely hardened metal strips welded directly to a body member such as a drill collar, blades machined integral with the body member or replaceable blades removably attached to the body member with suitable fastening means. The present invention is directed to the latter type.

Known U.S. patents which disclose various types of borehole wall contacting apparatus are as follows:

U.S. Pat. Nos. 1,062,841; 2,172,762; 2,189,033; 2,189,035; 2,306,492; 2,716,020; 3,445,144; 3,454,308; 3,680,647; 3,799,279; 3,856,096 and 3,938,852.

Replaceable blade stabilizers are commonly used because of the advantage of field replacement thus eliminating the necessity of a shop facility to rebuild or repair the tool. The replaceable blades or wear pads, as they are commonly called, are typically mounted on a fluted body for allowing substantially full flow of drilling fluid through the annulus formed by the drill string and borehole wall. The body upon which the replaceable wear pads are mounted may require substantial milling and machining which is costly. Such wear pads have typically been attached to the body with cap screws and nuts which are torqued to firmly secure the wear pad in position. An example of this type is shown in U.S. Pat. No. 3,680,647. Another type of attachment for wear pads is disclosed in above-mentioned U.S. Pat. No. 3,454,308 which uses a screw type fastening means to secure the replaceable wear pad.

In use, screw heads used to secure wear pads may become battered or otherwise damaged making it difficult and time-consuming to replace the wear pads. It is very important that the wear pads be firmly secured to the body so that the pads will not fall off even if the screws are damaged or broken off. In view of the extraordinary cost involved in the drilling of a well, down time plays a very significant factor in the overall cost. It is thus desirable to provide a mounting means for replaceable wear pads which firmly secures the wear pad in position so that it will not fall off in the borehole while still making it readily and quickly replaceable.

SUMMARY OF THE INVENTION

The invention relates to a new and improved borehole wall contacting apparatus having replaceable wear pads for use on a bottom hole assembly of a drill string.

The borehole contacting apparatus comprises a hollow, elongated cylindrical body portion with undercut grooves longitudinally extending along the outer surface thereof. The grooves are selectively positioned along the periphery of the body. Wear pads are lockingly received in said grooves. In a preferred embodiment, the grooves are dovetail shaped with outwardly converging sidewalls. Each wear pad consists of two coacting elements or blades. Each blade has at least one sidewall which converges at an angle from the base to the face, which angle coincides and matches with the angle of the sidewall of the dovetail groove in the body. The opposite sidewall is non-parallel to the longitudinal axis of the wear pad body. The non-parallel wall of adjacent blades being positioned in abutting relationship and acting as camming walls on the coacting wear blades so that wedging effect is acheived to laterally force the sidewalls of the coacting pair of wear blades into engagement with the sidewalls of the dovetail groove to firmly secure the wear pads into position. The wear pads are securely held in position since the coacting camming surfaces require movement in opposite directions to free the wear pads from the undercut groove.

DETAILED DESCRIPTION OF THE PREFERRED EMBODIMENTS

Figure 1:
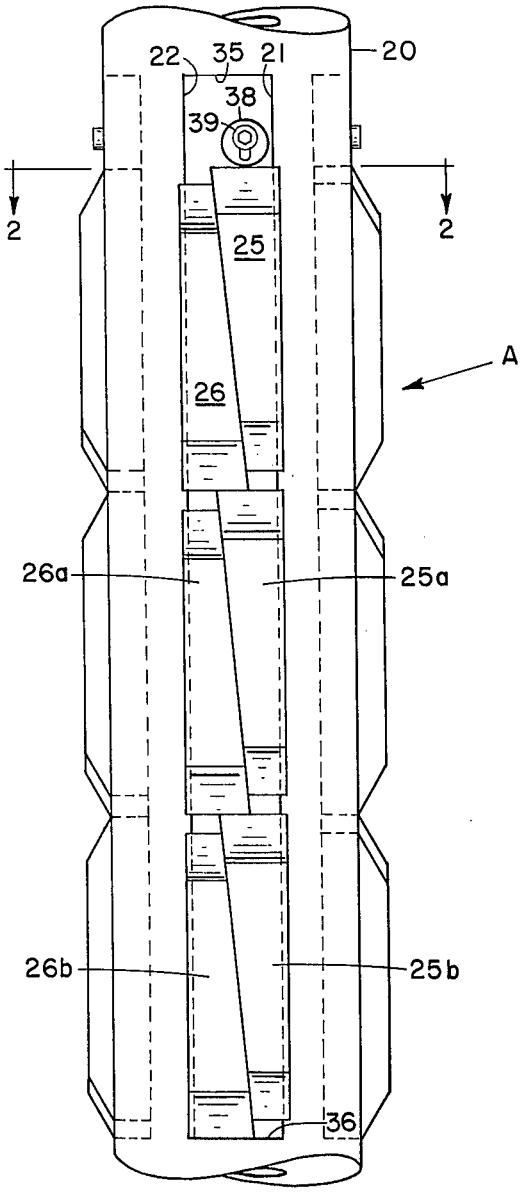
FIG. 1 is a side elevation of a portion of a bottom hole assembly of a drilling string showing a preferred embodiment of this invention.

Referring to FIG. 1 of the drawings, there is shown a segment of a bottom hole assembly A of a drill string in accordance with the invention. The borehole wall contacting apparatus includes a body portion 20 which may take the form of a conventional drill collar.

Figure 2:
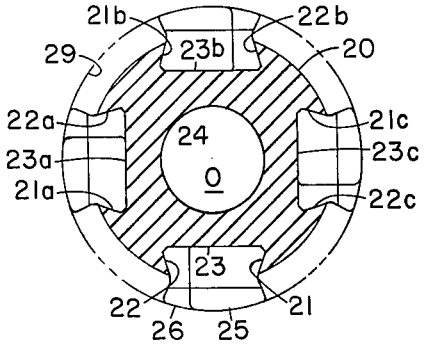
FIG. 2 is a cross section view taken along line 2—2 in FIG. 1.

The borehole wall contacting apparatus includes a plurality of coacting wear pads as explained more fully hereinafter. The body portion 20, includes a plurality of undercut retaining grooves which are preferably dovetail grooves formed therein as best shown in FIG. 2. While a dovetail groove is the preferred configuration, it is contemplated that other shapes of undercut grooves such as a T-shaped groove might be utilized. The undercut retaining groove is defined by sidewalls 21 and 22 and a base wall 23. The body portion 20 further includes an opening O as defined by cylindrical wall 24 which extends throughout the length of the body portion 20 to allow passage of drilling fluids as is well known in the art. The body portion 20 is made of suitable material such as high strength steel to provide the necessary strength to prevent twisting or breaking thereof.

Figure 3:
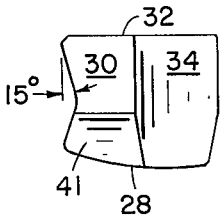
FIG. 3 is a top plan view of the wear pad as shown in FIG. 4.
Figure 4:
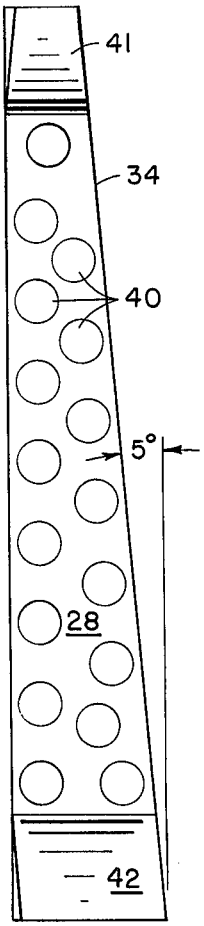
FIG. 4. is a side elevation of the wear pad.
Figure 5:
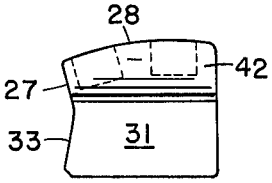
FIG. 5 is a bottom plan view of the wear pad as shown in FIG. 4.

The sidewalls 21 and 22 form angles on the order of about 15° with a perpendicular to the base wall 23. It is contemplated that the angle of the sidewalls relative to the base wall may be varied some while retaining the desirable attribute of retaining the coacting wear pads or blades. In the depicted embodiment, the body 20 includes four identical dovetail grooves equally spaced around the periphery of the body portion and which have been identified by adding the letters *a, b,* and *c* to the numbers 21, 22 and 23 as best shown in FIG. 2. It will be understood that other arrangements of grooves such as three equally spaced grooves may also be used. The borehole wall contacting members or wear pads comprises two identical elements or blades 25 and 26. The wear blades 25 and 26 are best shown in FIGS. 3, 4 and 5. As shown in FIG. 1, three pairs of coacting wear blades, which have been designated 25, 26, 25*a,* 26*a* and 25*b,* 26*b* are inserted in each groove, however, this number is completely arbitrary and the length of the groove may be varied to allow insertion of the desired number of pairs of blades.

Referring to FIGS. 3, 4 and 5, each wear blade is identical and has a face portion 28 which is designed to contact the cylindrical inner surface of a borehole, which by way of example, is defined by the cylindrical surface 29 as best shown in FIG. 2. The face portion 28 has beveled surfaces 41 and 42 at its ends. The wear blade further includes an upper end surface 30 as shown in FIG. 3 and a lower bottom surface 31 as best shown in FIG. 5. Back surface 32 is designed to contact the base wall 23 as best shown in FIG. 2.

Each wear blade further includes a wall contact surface 33 which is designed to contact either the sidewall 21 or 22 of the dovetail groove. The wear blades 25 and 26 are identical in construction so that it is necessary to describe only one of them. The wall contacting surface 33 is at an angle of about 15° to a perpendicular to the back surface 32 as best shown in FIGS. 3 and 4. The wall contacting surface 33 connects with wall portion 27 which extends to wear surface 28. It can be appreciated that this configuration is designed to provide maximum wear area for face portion 28.

Camming wall 34 as best shown in FIGS. 3 and 4 forms an angle of about 5° to a perpendicular to the bottom surface 31. Referring again to FIG. 1, it is apparent that each camming surface of the wear blades 25 and 26 will force the wall contacting surface of each wear blade outwardly into contact with the sidewalls 21 and 22 upon relative longitudinal movement of the wear blades toward each other. This is achieved by insertion of one of the wear blades, for instance 26*b* in the dovetail groove and then insertion of the other wear blade 25*b* in the groove. The wear blade 26*b* engages the lower end 36 of the dovetail groove so that it may not move longitudinally downward as shown in FIG. 1. The wear blade 25*b* upon downward sliding movement will engage the camming surfaces of the wear blade 26*b* so as to move the wall contacting surfaces of the respective wear blades 25*b* and 26*b* into tight engagement with the sidewalls 21 and 22 of the dovetail groove. Blade pairs 25*a,* 26*a* and 25, 26 are successively placed in the dovetail groove as depicted in FIG. 1.

Upon movement of the body member 20 through a borehole, the wear blades will be subjected to longitudinal forces due to friction of their wear surfaces engaging the borehole wall. For instance, when the drill string is lowered through a borehole, upward forces will be exerted upon both the wear blades 25 and 26 due to frictional contact. These upward forces will cancel each other out since the wear blades can only be loosened by longitudinal movement in opposite directions as opposed to the same direction. As shown in FIG. 1, there are three sets of wear blades, 25, 26 and 25*b,* 26*b,* and 25*a,* 26*a.* The dovetail groove includes an upper end wall 35 and a lower end wall 36. Since some longitudinal movement of the wear blades is required for their insertion, the dovetail groove as shown in FIG. 1 extends a length greater than the total length of the three sets of wear blades. While it is very unlikely that the wear blades can become disengaged from the dovetail groove as a result of the longitudinal forces acting on the blade as described supra, nevertheless, a locking means is provided in the upper end of the dovetail groove. The locking means consists of a cylindrical disc 38 which includes an eccentrically positioned opening therethrough through which is inserted a locking screw 39 which is screwed into a threaded opening (not shown) in the basewall 23. After the three sets of wear blades are inserted in the groove and are tightly driven into place so that the wear blade 26*b* engages the lower wall 36 and the other blades are in camming, coacting engagement with each other, disc 38 may be rotated so as to engage its outer peripheral surface with the upper end of the wear blade 25. The screw 39 may be then torqued tight so that all of the wear blades are tightly held in position. Although the locking disc 38 and locking screw 39 might be deleted, they are utilized as an extra safety precaution since the loss of a wear blade in a borehole could interfere with the removal of the drill string and possibly even damage the bit.

As shown in FIG. 5, wear resistant inserts 40 are mounted in the face portion 28 of the wear blades. The wear resistant inserts may include various forms such as inserts of tungsten carbide or other abrasive resistant material which may be inserted into openings in the face portion 28 as is well known in the art. Alternatively, weld beads of abrasive resistant materials may be formed on the face portion 28.

Replacement of the wear blades 25, 26, and 25*a,* 26*a,* and 25*b* and 26*b,* can be readily achieved as follows. The screw 39 may be removed so as to remove the locking disc 38 from the dovetail groove where it formerly engaged the upper end of the wear blade 25. This leaves an unfilled space at the upper portion of the groove. A pry bar or the like may then be inserted to engage the bottom end of wear blade 25 and the upper end of wear blade 25*a.* Since a great amount of force may be applied at this point, blade 25 can be forced upwardly so as to release it from the wear blade 26 for removing of these two coacting blades. This procedure may then be repeated for the remaining pairs of wear blades.

It will be apparent to those skilled in the art that many modifications may be made in the preferred embodiments of the present invention without departing from the spirit and scope thereof. Accordingly, it is intended that the present invention be limited only by the scope of the claims appended hereto.

I claim:

1. A borehole wall contacting apparatus for a drill string comprising:

an elongated body having a drilling fluid passage there-through and having means for mounting in a drill string;

a plurality of radially spaced retaining grooves formed in the outer surface of the elongated body with borehole wall contact means mounted therein;

said borehole wall contact means including at least one pair of coacting elements, each element including a borehole wall contact surface, a retaining groove contacting portion and a camming portion, said camming portions of said pair of elements being slidably engageable upon relative movement of the elements toward each other to force the retaining groove contacting portions into locking engagement with the retaining groove.

2. The apparatus of claim 1 wherein the retaining grooves have an undercut portion.

3. The apparatus of claim 1 wherein the retaining grooves include opposed outwardly converging side walls.

4. The apparatus of claim 3 wherein the retaining grooves are dovetail grooves.

5. The apparatus of claim 4 wherein the retaining grooves extend longitudinally.

6. The apparatus of claim 3 wherein the camming portion of each element includes a planar surface inclined at an angle nonparallel to the retaining groove contacting portion and the retaining groove contact portion of each element includes a sidewall substantially parallel to one of said outwardly converging sidewalls of said retaining groove.

7. The apparatus of claim 6 wherein the elements of each pair are mounted in the retaining groove with the inclined planar surfaces in opposed abutting relationship and with their outwardly diverging sidewalls being disposed opposite from each other and in abutting engagement with the opposed outwardly converging sidewalls of said retaining groove.

8. The apparatus of claim 7 wherein the coacting elements are identical in size and configuration.

9. The apparatus of claim 7 including a fastening means mounted in one end of said retaining groove, said fastening means engaging an end of one of said elements to lock said element against the other end of said retaining groove to prevent longitudinal movement of the elements.

10. The apparatus of claim 1 wherein the borehole wall contacting surface includes an abrasive resistant means for contact with the borehole wall.

11. The apparatus of claim 1 wherein the camming portion of each coacting element includes a planar surface inclined at an angle non-parallel to the retaining groove contacting portion.

12. A borehole wall contacting apparatus for a drill string comprising:

an elongated body having a drilling fluid passage therethrough and having means for mounting in a drill string;

a plurality of radially, equally spaced, longitudinally extending, undercut retaining grooves formed in the outer surface of the elongated body;

said retaining grooves having outwardly converging sidewalls;

a plurality of borehole wall contacting wear pads removably secured in each of said retaining grooves;

each of said wear pads consisting of a pair of elongated coacting wear blades;

each wear blade having a planar camming surface inclined at an angle to the longitudinal axis, a groove contact portion comprising a sidewall substantially parallel to one of said retaining groove outwardly converging sidewalls and a borehole wall contact surface having an abrasive resistant means thereon;

each pair of coacting wear blades being mounted in a retaining groove with their camming planar surfaces in opposed abutting relationship and with their outwardly diverging sidewalls being oppositely disposed and in abutting engagement with the outwardly converging sidewalls of said retaining groove.

13. A removable wear pad for use in a borehole wall contact apparatus for a drill string comprising:

a pair of coacting elongated wear blades, each of said blades having a planar camming surface inclined at an angle to its longitudinal axis, said camming planar surfaces being for opposed abutting relationship, each blade having a retaining groove contact wall, said contact walls being oppositely disposed when the camming planar surfaces are in opposed abutting relationship.

14. The apparatus of claim 13 wherein the wear blades are identical in size and configuration and wherein said opposite contact walls are inclined and converge toward each other.

* * * * *